US006564766B2

(12) United States Patent
Ayton

(10) Patent No.: US 6,564,766 B2
(45) Date of Patent: May 20, 2003

(54) AIR INDUCTION SYSTEM FOR AN AUTOMOBILE

(76) Inventor: W. Brooke Ayton, 10245 W. Airport, Stafford, Houston, TX (US) 77477

( * ) Notice: Subject to any disclaimer, the term of this patent is extended or adjusted under 35 U.S.C. 154(b) by 0 days.

(21) Appl. No.: 09/917,001

(22) Filed: Jul. 27, 2001

(65) Prior Publication Data

US 2003/0019456 A1 Jan. 30, 2003

(51) Int. Cl.[7] ..... F02M 35/10
(52) U.S. Cl. ..... 123/184.21
(58) Field of Search ..... 123/184.21, 184.61, 123/198 E, 184.34, 184.42; 55/385.3; 29/888.01, 888.08, 888.052

(56) References Cited

U.S. PATENT DOCUMENTS 5,003,933 A * 4/1991 Rush, II et al. ..... 123/184.42
5,170,754 A * 12/1992 Urabe ..... 123/184.31
5,640,937 A * 6/1997 Slopsema ..... 123/198 E
6,263,850 B1 * 7/2001 Winmill et al. ..... 123/184.21

FOREIGN PATENT DOCUMENTS

GB 2239898 A * 7/1991

* cited by examiner

*Primary Examiner*—Noah P. Kamen
*Assistant Examiner*—Hyder Ali

(57) ABSTRACT

An improved air box lid and an improved air conveyance tube may be used alone and/or in combination to improve engine performance. For example, the improved air box lid and the improved air conveyance tube may be used together in an air induction system to increase the flow of ambient air from an air intake box to the motor throttle body. The improved air box lid and the improved air conveyance tube are preferably provided with interior walls that are smooth and continuous and define only obtuse interior angles.

23 Claims, 8 Drawing Sheets

AIR INDUCTION SYSTEM FOR AN AUTOMOBILE

FIELD OF THE INVENTION

The present invention relates to automobile engines and more specifically, to air induction systems and components thereof.

BACKGROUND OF THE INVENTION

An example of a prior air induction assembly is disclosed in U.S. Pat. No. 5,640,937 to Slopsema. An object of the present invention is to provide an improved air induction assembly and/or components thereof.

SUMMARY OF THE INVENTION

The present invention provides components designed for connection to a throttle body on a motor, and/or for connection in series between an existing throttle body and an existing air intake box. The components are preferably arranged to cooperate with the air intake box and the throttle body to define an air induction system. The components are preferably designed to encourage optimal air flow and facilitate cost effective manufacture and assembly. Many features and/or advantages of the present invention may become apparent from the detailed description that follows.

BRIEF DESCRIPTION OF THE FIGURES OF THE DRAWING

With reference to the figures of the Drawing, wherein like numerals represent like parts and assemblies throughout the several views.

DETAILED DESCRIPTION OF A PREFERRED EMBODIMENT

Figure 2:
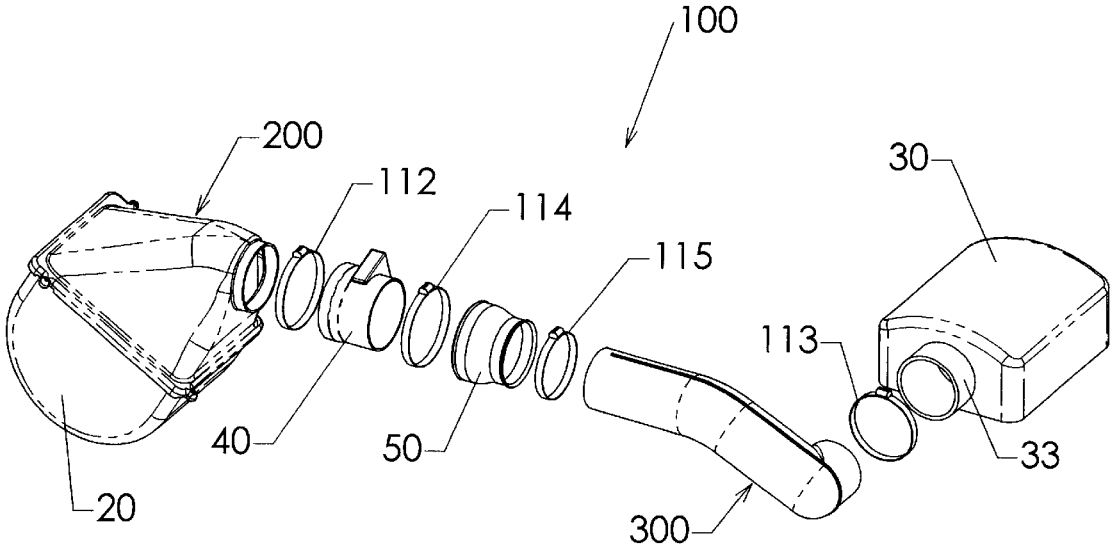
FIG. 2 is an exploded perspective view of the air induction system of FIG. 1.
Figure 1:
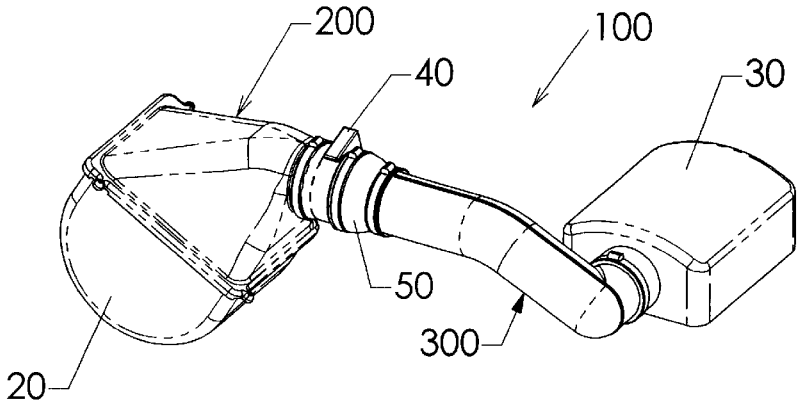
FIG. 1 is a perspective view of an air induction system constructed according to the principles of the present invention.
Figure 3:
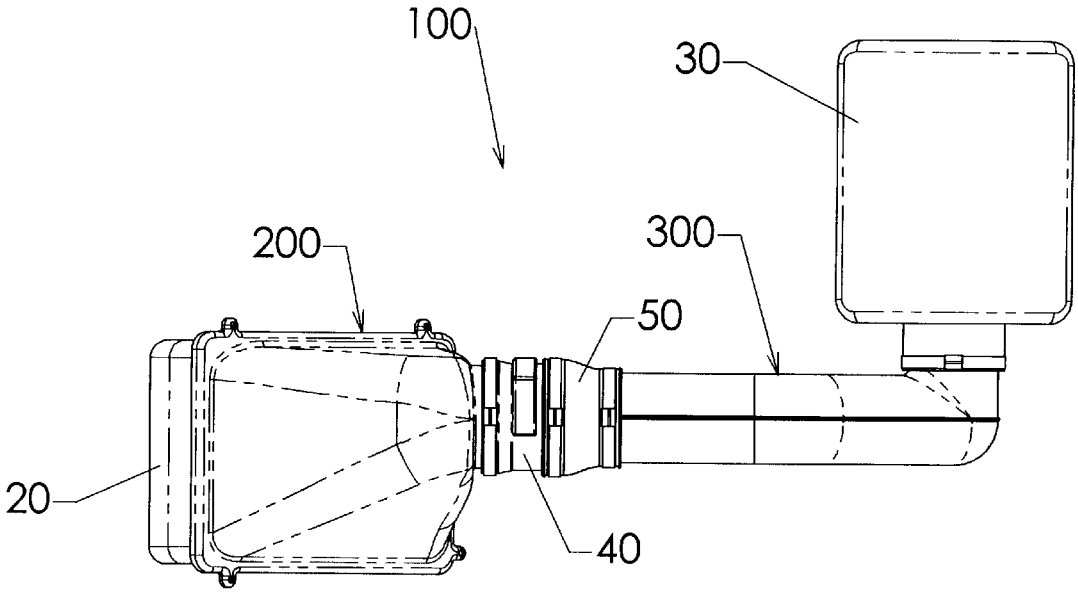
FIG. 3 is a top view of the air induction system of FIG. 1.
Figure 4:
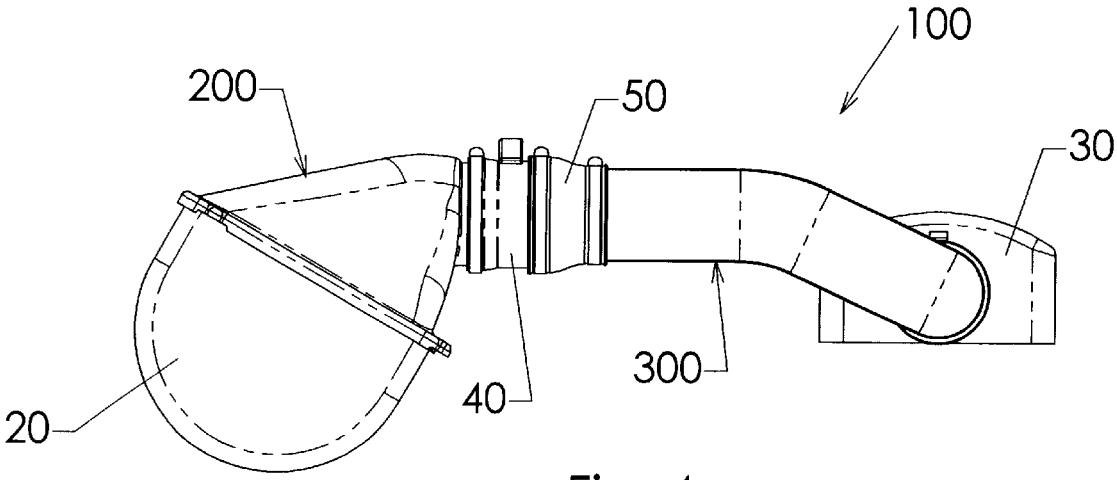
FIG. 4 is a side view of the air induction system of FIG. 1.
Figure 5:
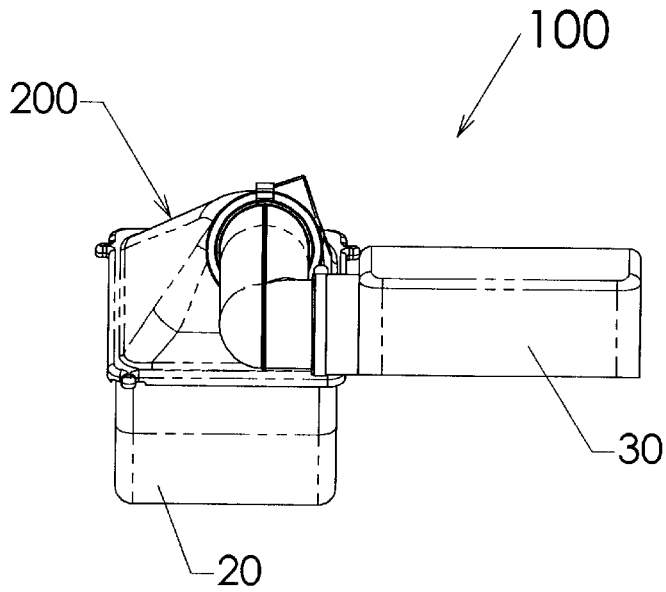
FIG. 5 is a front view of the air induction system of FIG. 1.
Figure 6:
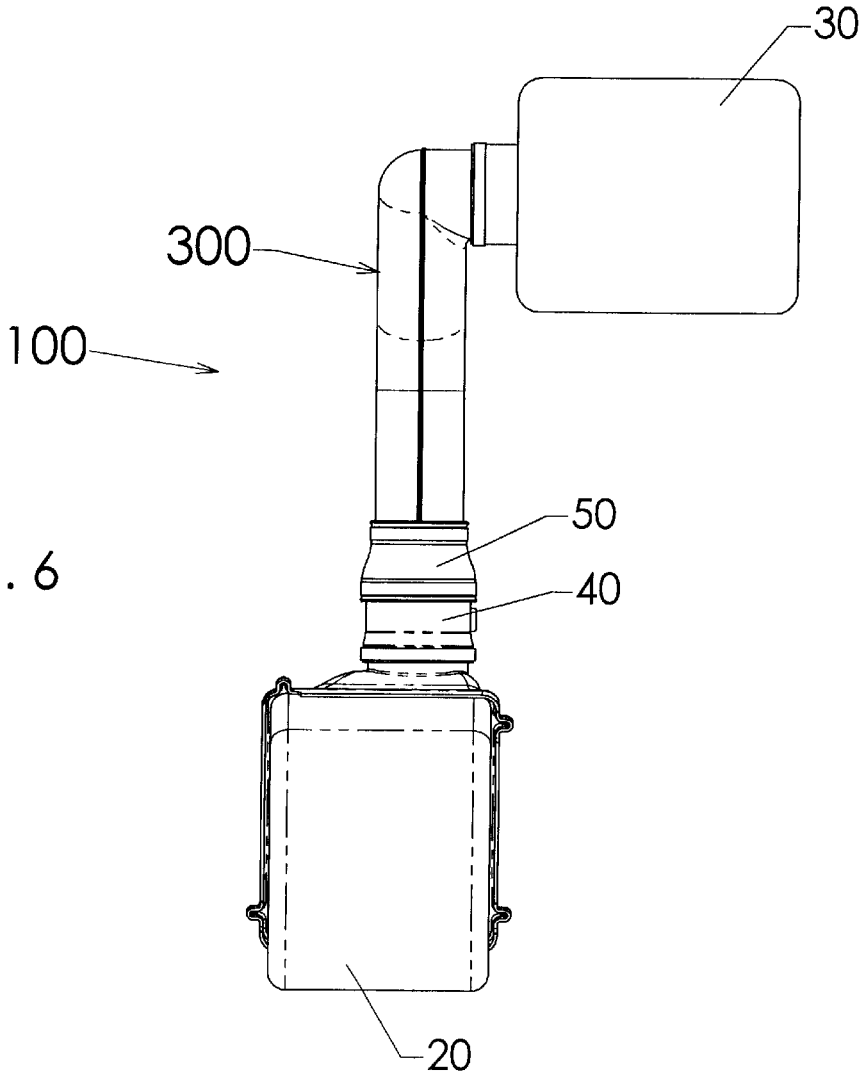
FIG. 6 is a bottom view of the air induction system of FIG. 1.
Figure 7:
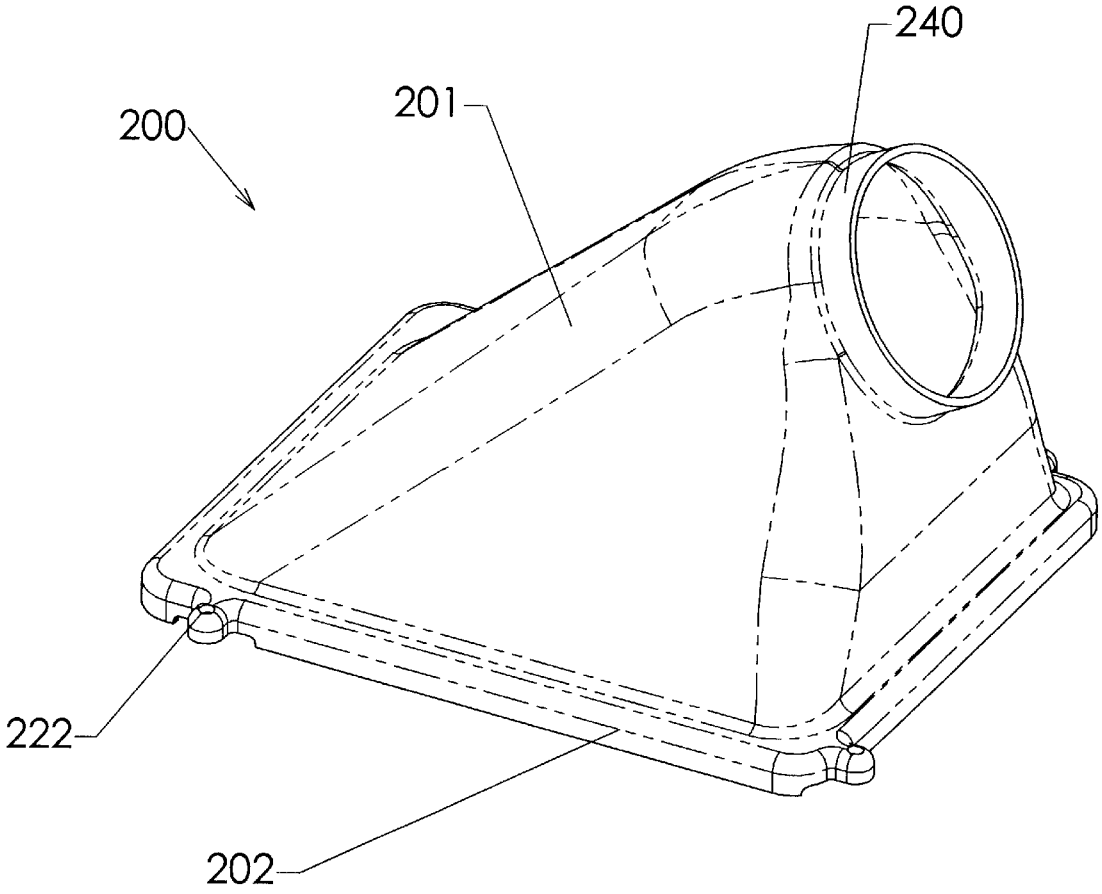
FIG. 7 is a perspective view of a lid that is part of the air induction system of FIG. 1.
Figure 8:
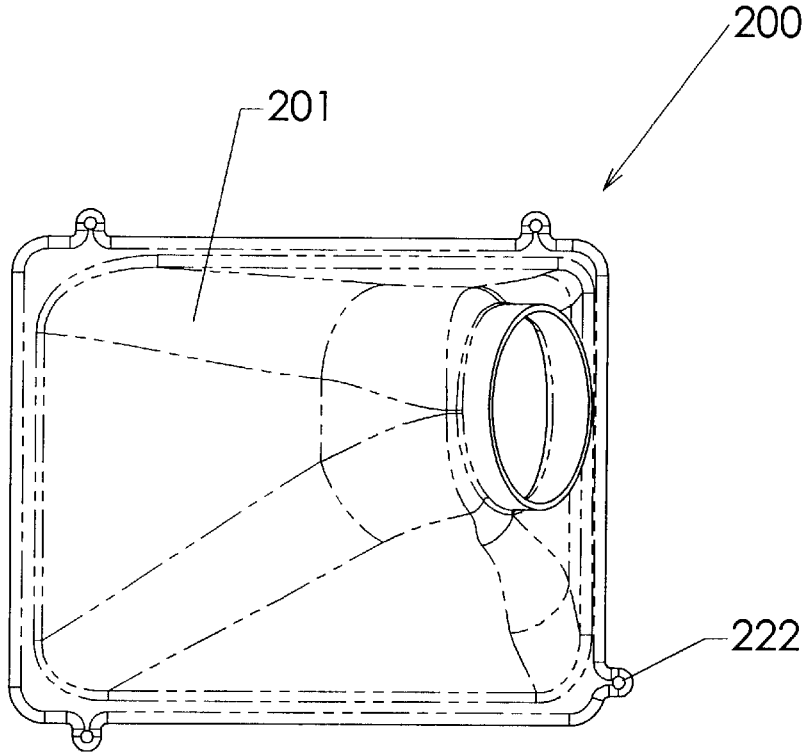
FIG. 8 is a top view of the lid of FIG. 7.
Figure 9:
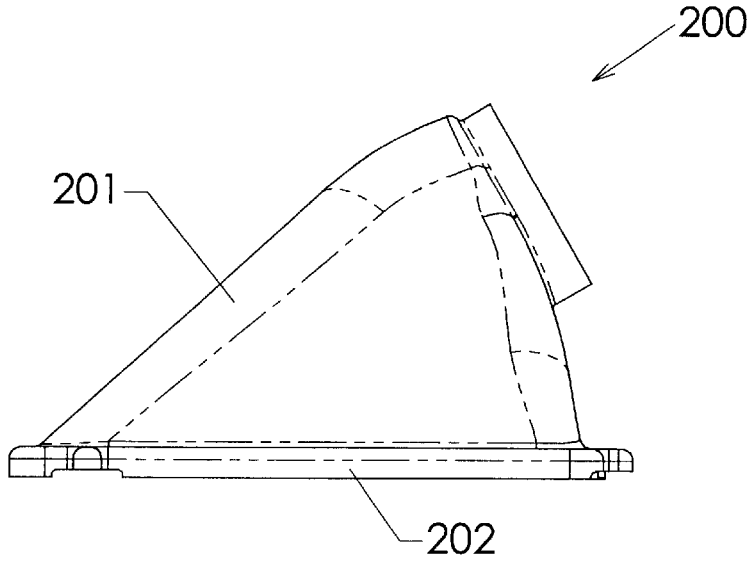
FIG. 9 is a side view of the lid of FIG. 7.
Figure 10:
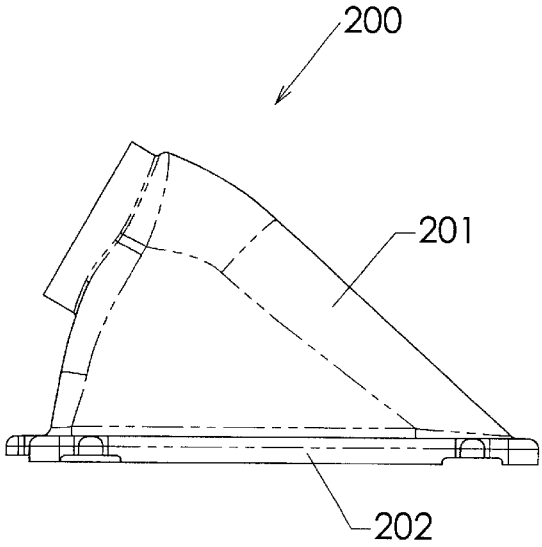
FIG. 10 is an opposite side view of the lid of FIG. 7.
Figure 11:
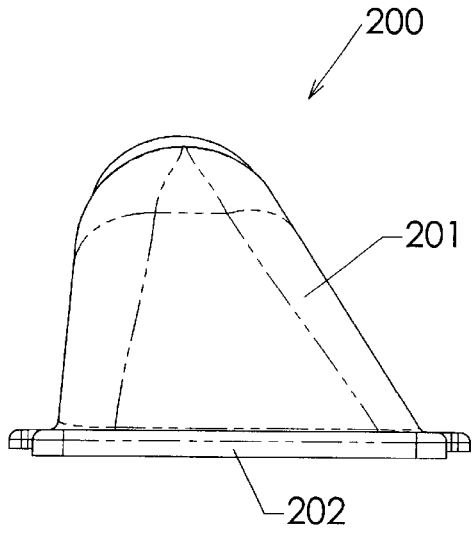
FIG. 11 is a rear view of the lid of FIG. 7.
Figure 12:
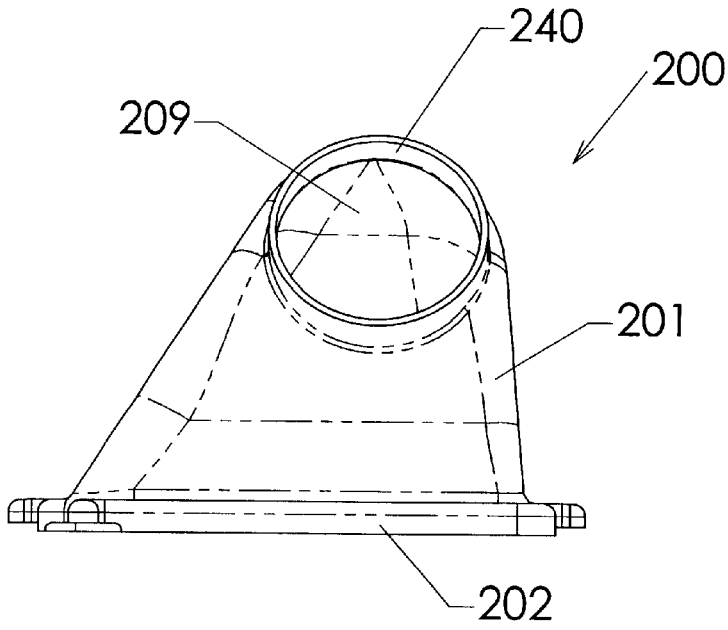
FIG. 12 is a front view of the lid of FIG. 7.
Figure 13:
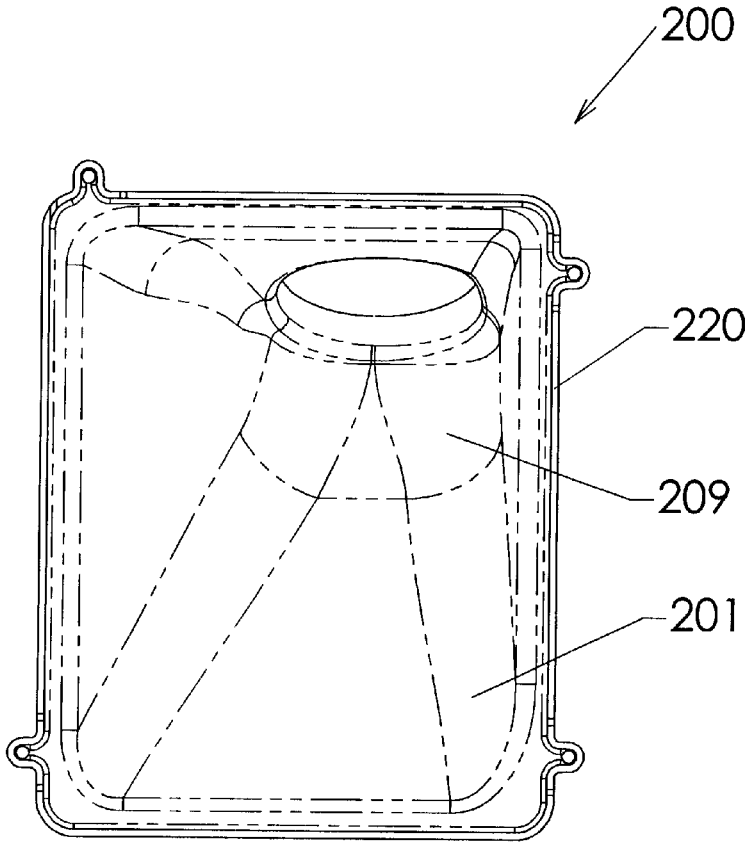
FIG. 13 is a bottom view of the lid of FIG. 7.

FIGS. 1–6 show a preferred embodiment air induction system 100 constructed according to the principles of the present invention. Generally speaking, the system 100 performs the same basic function as the system disclosed in U.S. Pat. No. 5,640,937 to Slopsema, which is incorporated herein by reference. Accordingly, the following description will focus primarily on the distinctions between the Slopsema system and the subject invention.

The system 100 is preferably designed for retrofit applications to existing automobiles, but may be installed during manufacture, as well. In any event, one end of the system 100 terminates in a conventional air intake box 20, and an opposite end of the system 100 terminates in a conventional motor throttle body 30. The motor throttle body 30 is mounted on a conventional, fuel-injected engine, and the air intake box 20 is typically mounted in proximity to a fender well on an automobile (thereby facilitating intake of ambient air, as opposed to air within the engine compartment).

The present invention provides an air intake box lid 200 that is sized and configured for mounting on the air intake box 20 (in place of a factory installed lid), and an air conveyance tube 300 that is sized and configured to mounting on the motor throttle body 30 (in place of a factory installed tube). The other components of the system 100 are commercially available parts.

One end of a conventional mass air flow meter 40 is secured to a neck 240 on the lid 200 by means of a variable circumference clamp 112 and associated air seal (or other suitable means known in the art). An opposite end of the mass air flow meter 40 is secured to a first end of a neoprene collar 50 by means of another variable circumference clamp 114. An opposite, second end of the neoprene collar 50 is secured to a first end of the tube 300 by means of another variable circumference clamp 115. An opposite, second end of the tube 300 is secured to a neck 33 on the motor throttle body 30 by means of yet another variable circumference clamp 113 and associated air seal. The foregoing connections are intended to establish an air-tight conduit between the air intake box 20 and the motor throttle body 30.

The air intake box lid 200, which is shown by itself in FIGS. 7–13, is preferably formed as a single, unitary part by vacuum form molding ABS plastic (or some other suitable material) The lid 200 may be generally described as a pyramid-shaped shell having a four-sided base 202 and sidewalls 201 that form smooth and rounded junctures therebetween. The sidewalls 201 define an interior surface 209 that is smooth and continuous, and preferably devoid of acute angles. A lip 220 extends about the perimeter of the base 202 and is configured to form an air-tight seal with the air intake box 220. An air filter (not shown) is preferably disposed across the opening that is shared between the air intake box 20 and the box lid 200 (to remove impurities from the air before it passes through the system 100).

Figure 14:
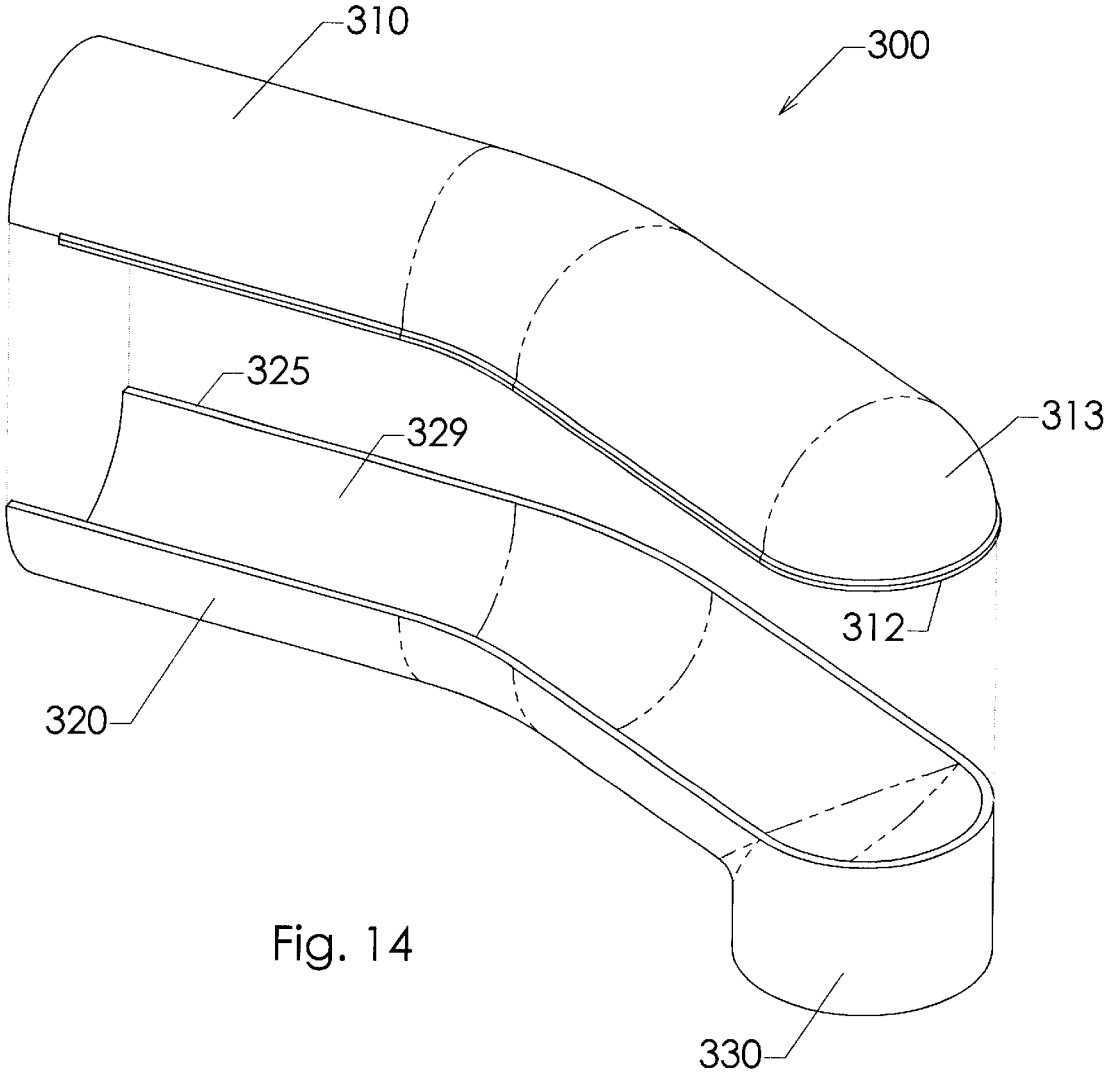
FIG. 14 is an exploded perspective view of a tube that is part of the air induction system of FIG. 1.

The air conveyance tube 300, which is shown by itself in FIG. 14, is preferably formed as two complementary parts 310 and 320 by vacuum form molding ABS plastic (or some other suitable material). The first part 310 may be described as an elongate shell having a semi-circular profile. A first end of the part 310 is open-ended, and an opposite, second end 313 of the part defines a rounded, cup-shaped enclosure or end wall. A generally U-shaped lip 312 extends about the closed end 313 and has first and second distal ends that terminate just short of the opposite, open end of the part 310. The second part 320 may similarly be described as an elongate shell having a semi-circular profile. A first end of the part 320 is similarly open-ended, and the opposite end of the part 320 terminates in a neck 330 that extends perpendicular to the longitudinal, axis of the tube 300 and away from the closed end 313 on the other part 310.

The parts 310 and 320 have respective, flat, U-shaped surfaces 325 that align with one another and abut one another when the tube 300 is assembled. The lip 312 on the part 310 is sized and configured to overlap an adjacent edge portion of the part 320, and facilitate an effective bond therebetween. In this regard, the two parts 310 and 320 may be secured together by various known means, including chemical bonding, adhesives, and/or various forms of welding. The lip 312 extends less than the full length of the tube 330 to leave room for application of the clamp 115 about the end of the tube 330. When bonded together, the parts 310 and 320 provide a cylindrical tube 300 having a smooth and uninterrupted interior surface. A slight bend is preferably provided in an intermediate portion of the tube 300 to accommodate a pre-existing spatial relationship between the motor throttle body 30 and the air intake box 20 on certain existing vehicles.

The present invention may also be described in terms of various methods. For example, the present invention may be said to provide a method of improving an existing air induction system of the type that conveys ambient air from an air intake box to a motor throttle body on an automotive engine (such as the one disclosed in the Slopsema patent). In such circumstances, the existing air induction system is disconnected from the existing motor throttle body by disconnecting an existing air conveyance tube from the motor throttle body; the existing air intake box lid is disconnected from the air intake box; and the existing mass air flow meter is removed from the existing air induction system. The improved air intake box lid 200 is provided with interior walls that cooperate to define a smooth and continuous interior surface, and the improved air conveyance tube 300 is provided with interior walls that cooperate to define a smooth and continuous interior surface. The existing mass air flow meter is interconnected between the improved air intake box lid and the improved air conveyance tube; the improved air intake box lid is secured to the air intake box; and the improved air conveyance tube is secured to the motor throttle body. All of the securing steps are performed in a manner that places the air intake box in air-tight, fluid communication with the motor throttle body.

The foregoing disclosure is directed toward a preferred embodiment and particular application of the present invention. However, this disclosure will lead those skilled in the art to derive additional embodiments and/or applications. For example, the air box lid 200 and the air conveyance tube 300 may be used together or separately. In the latter case, the air box lid 200 may be used with a conventional air conveyance tube, or the air conveyance tube 300 may be used as part of a nitrous oxide delivery system. In any event, the scope of the present invention should be limited only to the extent of the following claims.

What is claimed is:

1. A method of improving an existing air induction system that conveys ambient air from an air intake box to a motor throttle body on an automotive engine, comprising the steps of:

disconnecting the existing air induction system from the existing motor throttle body by disconnecting an existing air intake conveyance tube from the motor throttle body;

disconnecting an existing air intake box lid from the air intake box;

removing an existing mass air flow meter from the existing air induction system;

providing an improved air intake box lid having interior walls that cooperate to define a smooth and continuous interior surface about an air flow passage that extends in continually narrowing fashion between first and second ends of the improved air intake box lid;

providing an improved air intake conveyance tube having interior walls that cooperate to define a smooth and continuous interior surface;

securing the existing mass air flow meter between the improved air intake box lid and the improved air intake conveyance tube;

securing the improved air intake box lid to the air intake box; and securing the improved air intake conveyance tube to the motor throttle body, wherein the securing steps are performed in a manner that places the air intake box in fluid communication with the motor throttle body.

2. The method of claim 1, wherein the step of providing an improved air intake box lid involves vacuum form molding of the improved air intake box lid.

3. The method of claim 2, wherein the improved air intake box lid is vacuum form molded as a single unitary part.

4. The method of claim 3, wherein the improved air intake box lid is vacuum form molded into a pyramid-shaped shell having an open, base end that mates with the existing air intake box in a manner similar to the existing air intake box lid, and a generally opposite, neck end that is relatively smaller and mates with the existing mass air flow meter in a manner similar to the existing air intake box lid.

5. The method of claim 2, wherein the improved air intake box lid is vacuum form molded in such a manner that only obtuse angles are defined at junctures between adjacent interior walls.

6. The method of claim 1, wherein the step of providing an improved air intake conveyance tube involves vacuum form molding of the improved air intake conveyance tube.

7. The method of claim 6, wherein the improved air intake conveyance tube is vacuum form molded as two complementary parts.

8. The method of claim 7, wherein the two complementary parts are bonded together along a generally U-shaped seam.

9. The method of claim 6, wherein the improved air intake conveyance tube is vacuum form molded in such a manner that only obtuse angles are defined at junctures between adjacent interior walls.

10. The method of claim 1, wherein the step of providing an improved air intake box lid involves vacuum form molding of the improved air intake box lid in such a manner that the air flow passage extends as a single, undivided passage between the first and second ends of the improved air intake box lid.

11. A method of improving an existing air induction system that conveys ambient air from an air intake box to a motor throttle body on an automotive engine, comprising the steps of:

disconnecting the existing air induction system from the existing motor throttle body by disconnecting an existing air conveyance tube from the motor throttle body;

disconnecting an existing air intake box lid from the air intake box;

removing an existing mass air flow meter from the existing air induction system;

providing an improved air intake box lid having interior walls that cooperate to define a smooth and continuous interior surface;

vacuum form molding two complementary parts that cooperate to form an improved air conveyance tube having interior walls that cooperate to define a smooth and continuous interior surface;

connecting the two complementary parts together by forming a generally U-shaped bond between the two complementary parts, wherein opposite distal ends of the bond terminate close to one end of the improved air conveyance tube, and securing a clamp fitting on the one end just beyond the distal ends of the bond;

securing the existing mass air flow meter between the improved air intake box lid and the improved air conveyance tube;

securing the improved air intake box lid to the air intake box; and securing the improved air conveyance tube to the motor throttle body, wherein the securing steps are performed in a manner that places the air intake box in fluid communication with the motor throttle body.

12. The method of claim 11, wherein the bond extends about an opposite end of the improved air conveyance tube.

13. The method of claim 12, wherein at the opposite end of the improved air conveyance tube, one of the complementary parts is provided with a neck that mates with the existing motor throttle body in a manner similar to the existing air conveyance tube.

14. The method of claim 13, wherein at the opposite end of the improved air conveyance tube, an opposite one of the complementary parts is provided with an opposing interior sidewall that aligns with the neck and defines a smooth and continuous ninety degree curve.

15. A method of improving an existing air induction system that conveys ambient air from an air intake box to a motor throttle body on an automotive engine, comprising the steps of:

disconnecting the existing air induction system from the existing motor throttle body by disconnecting an existing air intake conveyance tube from the motor throttle body;

disconnecting an existing air intake box lid from the air intake box;

removing an existing mass air flow meter from the existing air induction system;

vacuum form molding a replacement air intake box lid as a single, unitary part;

vacuum form molding a replacement air intake conveyance tube as two complementary parts that are subsequently secured together, wherein both the replacement air intake conveyance tube and the replacement air intake box lid have interior walls that cooperate to define a respective smooth end continuous interior surface about a respective air flow passage, and all junctures between adjacent interior walls define respective angles greater than ninety degrees;

securing the existing mass air flow meter between the replacement air intake box lid and the replacement air intake conveyance tube;

securing the replacement air intake box lid to the air intake box in a manner similar to how the existing air intake box lid was secured to the air intake box; and securing the replacement air intake conveyance tube to the motor throttle body in a manner similar to how the existing air intake conveyance tube was secured to the motor throttle body, wherein the securing steps are performed in a manner that places the air intake box in fluid communication with the motor throttle body.

16. The method of claim 15, wherein each of the complementary parts is molded into an elongate shell having a hemispherical profile.

17. The method of claim 15, wherein the improved air intake conveyance tube is formed with a straight end and a curved end to accommodate a spatial relationship between the existing air intake box and the existing motor throttle body on the automotive engine.

18. The method of claim 15, wherein the improved air intake conveyance tube is formed with an intermediate bend to accommodate a spatial relationship between the existing air intake box and the existing motor throttle body on the automotive engine.

19. An improved air induction system that conveys ambient air from an air intake box to a motor throttle body on an automotive engine, comprising:

a pyramid-shaped air intake box lid having interior walls that are smooth and continuous and extend in convergent fashion from a base that is sized and configured for connection to the air intake box, to a neck that is sized and configured to connection to a cylindrical member;

an air intake conveyance tube having interior walls that are smooth and continuous, with all junctures between adjacent interior walls defining angles greater than ninety degrees, wherein the air intake conveyance tube has a neck that is sized and configured for connection to the motor throttle body; and a mass air flow meter interconnected between the air intake box lid and the air intake conveyance tube.

20. A method of improving an existing air induction system that conveys ambient air from an air intake box to a motor throttle body on an automotive engine, comprising the steps of:

removing an existing air conveyance tube from the existing air induction system;

vacuum form molding first and second complementary parts as respective elongate shells that cooperate to form an improved air conveyance tube having a longitudinal axis and a circumferential interior sidewall that extends axially in smooth and uninterrupted fashion;

connecting the complementary parts together to form the improved air conveyance tube; and securing the improved air conveyance tube in series between the air intake box and the motor throttle body to place the air intake box in fluid communication with the motor throttle body.

21. The method of claim 20, wherein the complementary parts are connected in a manner that forms a generally U-shaped bond between the complementary parts, and opposite distal ends of the bond terminate proximate one end of the improved air conveyance tube, and a clamp fitting is secured on the one end just beyond the distal ends of the bond.

22. The method of claim 21, wherein the U-shaped bond lies in a plane, and an opposite, second end of the improved air conveyance tube includes a neck that extends in a direction perpendicular to the plane, and the securing step involves securing the neck to the motor throttle body.

23. The method of claim 21, wherein the securing step involves securing the improved air conveyance tube to an existing mass air flow meter, which in turn, is secured to the air intake box.

* * * * *